US007392608B1

(12) United States Patent
Jacobs/Ziebell

(10) Patent No.: US 7,392,608 B1
(45) Date of Patent: Jul. 1, 2008

(54) NOTE CARD PROTECTOR

(75) Inventor: Joan Margaret Jacobs/Ziebell, Kelseyville, CA (US)

(73) Assignee: Heartwarmers LLC, Kelseyville, CA (US)

( * ) Notice: Subject to any disclaimer, the term of this patent is extended or adjusted under 35 U.S.C. 154(b) by 0 days.

(21) Appl. No.: 10/423,762

(22) Filed: Apr. 28, 2003

(51) Int. Cl.
*G09F 1/00* (2006.01)
*B65D 27/00* (2006.01)

(52) U.S. Cl. ..... 40/124.06; 229/68.1; 40/124.09

(58) Field of Classification Search ..... 229/68.1, 229/75, 92.8, 67.1; 383/66, 41; 206/312; 150/160; 40/124.06, 124.09, 124.11
See application file for complete search history.

(56) References Cited

U.S. PATENT DOCUMENTS 1,057,743 A * 4/1913 Klaber ..... 229/67.1
1,792,582 A * 2/1931 Goldsmith ..... 206/223
2,005,493 A * 6/1935 Blackwell ..... 229/68.1
3,127,089 A * 3/1964 Freeman ..... 206/312
4,744,509 A * 5/1988 Buchler-Dopheide ..... 229/92.1
4,811,768 A * 3/1989 Williams ..... 150/102
5,050,729 A * 9/1991 Karbowniczak ..... 206/83
5,236,121 A * 8/1993 Wollman et al. ..... 229/76
6,053,399 A * 4/2000 Wurdeman ..... 229/68.1
6,220,504 B1 * 4/2001 Flynn et al. ..... 229/71
6,296,164 B1 * 10/2001 Russo ..... 224/602

* cited by examiner

*Primary Examiner*—Jes F Pascua
(74) *Attorney, Agent, or Firm*—Edward S. Sherman

(57) ABSTRACT

A combination note card and protector, now known commercially as the a Heart Warmer®, is an unattached pocket made of fabric where a side folds down to display a card, trinket, or other sentiment. Its purpose is to send a greeting, trinket or other sentiment, which is held in the pocket, to a loved one. The recipient can then place the Heart Warmer® in his pocket close to his heart. It is constructed out of a single piece of fabric folded in half and sewn on at least portion of the sides with the a corner of the fabric folded down to create a pocket effect. It preferably comes with a card that fits into the pocket for the sender to write a personal message to the recipient.

13 Claims, 6 Drawing Sheets

The Original Heart Warmer is designed to send a message of affection & support to our friends or loved ones with a soft pocket they can carry close to their heart!

Instructions: Write your message on the enclosed card & mail!

Thank You!

*Made in the USA*

Onion Patch Productions
www.onionpatch.com

UPC Code?

NOTE CARD PROTECTOR

CROSS REFERENCE TO RELATED APPLICATIONS

Not Applicable

STATEMENT REGARDING FEDERALLY SPONSORED RESEARCH AND DEVELOPMENT

Not Applicable

REFERENCE TO SEQUENCE LISTING, A TABLE, OR A COMPUTER PROGRAM LISTING APPENDIX

Not Applicable

BACKGROUND OF THE INVENTION

The present invention relates to a device to hold greetings, salutations, sentiments or trinkets and the like.

BRIEF SUMMARY OF THE INVENTION

A device for use as a note card delivery system and protector, now known commercially the Heart Warmer® is a cloth pocket or pouch, which may take a variety of shapes and sizes optionally includes a blank card placed inside to write a personal message to a friend or loved one, and is especially designed to send a message to those in the service overseas. It is also designed to hold trinkets, charms, or other selected items.

It is preferably displayed at the point of sales in a clear wrapper and will include the cloth pocket, a blank card, envelope for mailing and instructions. The above and other objects, effects, features, and advantages of the present invention will become more apparent from the following description of the embodiments thereof taken in conjunction with the accompanying drawings.

DETAILED DESCRIPTION

Figure 1A:
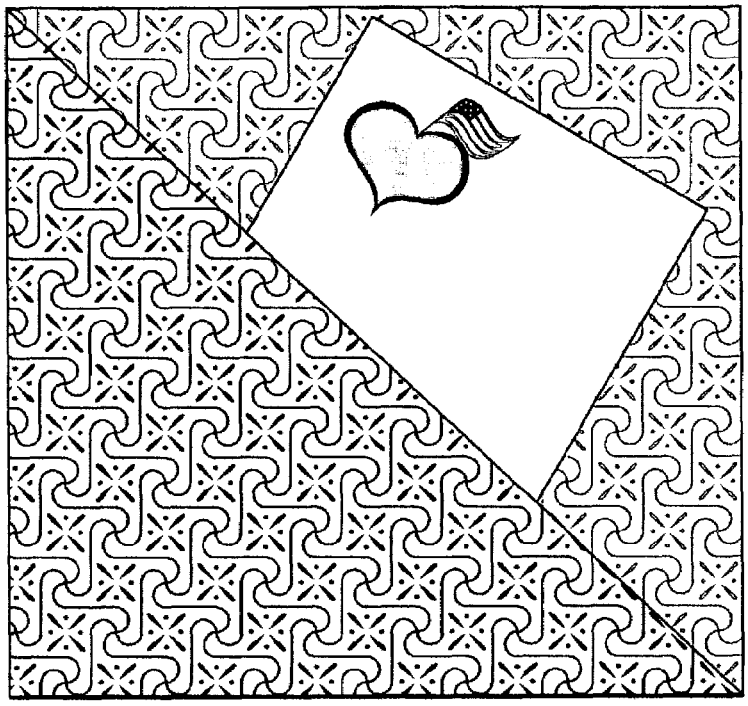
FIG. 1A: depicts the size and shape of the pocket and how the card is displayed inside the pocket.
Figure 1B:
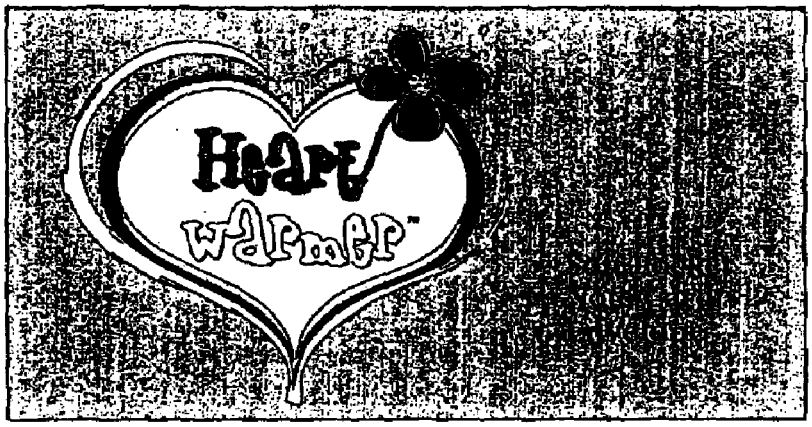
FIG. 1B: depicts the front view of the card that the cloth pocket will be placed in which will show through the clear packaging. This card will be folded so that the instructions (FIG. 1C) are behind the cloth pocket and the Heart Warmer logo will show on the front of package.
Figure 1C:
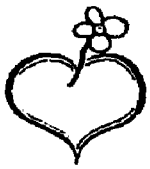
FIG. 1C depicts the rear view of the card that the cloth pocket will be placed in which will show through the clear packaging. This card will be folded so that the logo (FIG. 1B) is in front of the cloth pocket and the instructions will show on the back of the package.
Figure 1D:
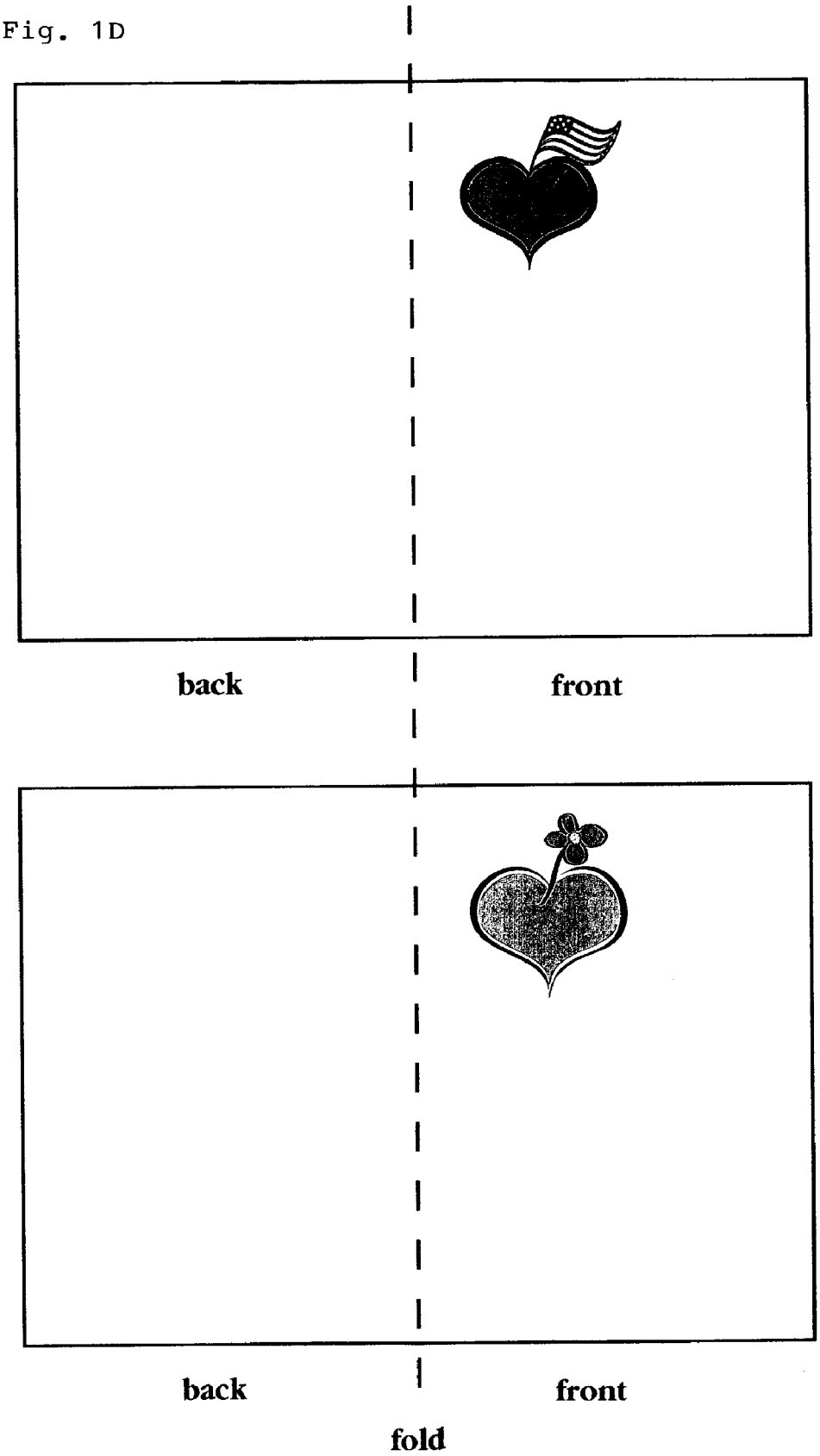
FIG. 1D depicts the full size of the card to be placed inside the pocket. This card will actually be folded in half and the sender will write his message inside the card.
Figure 2:
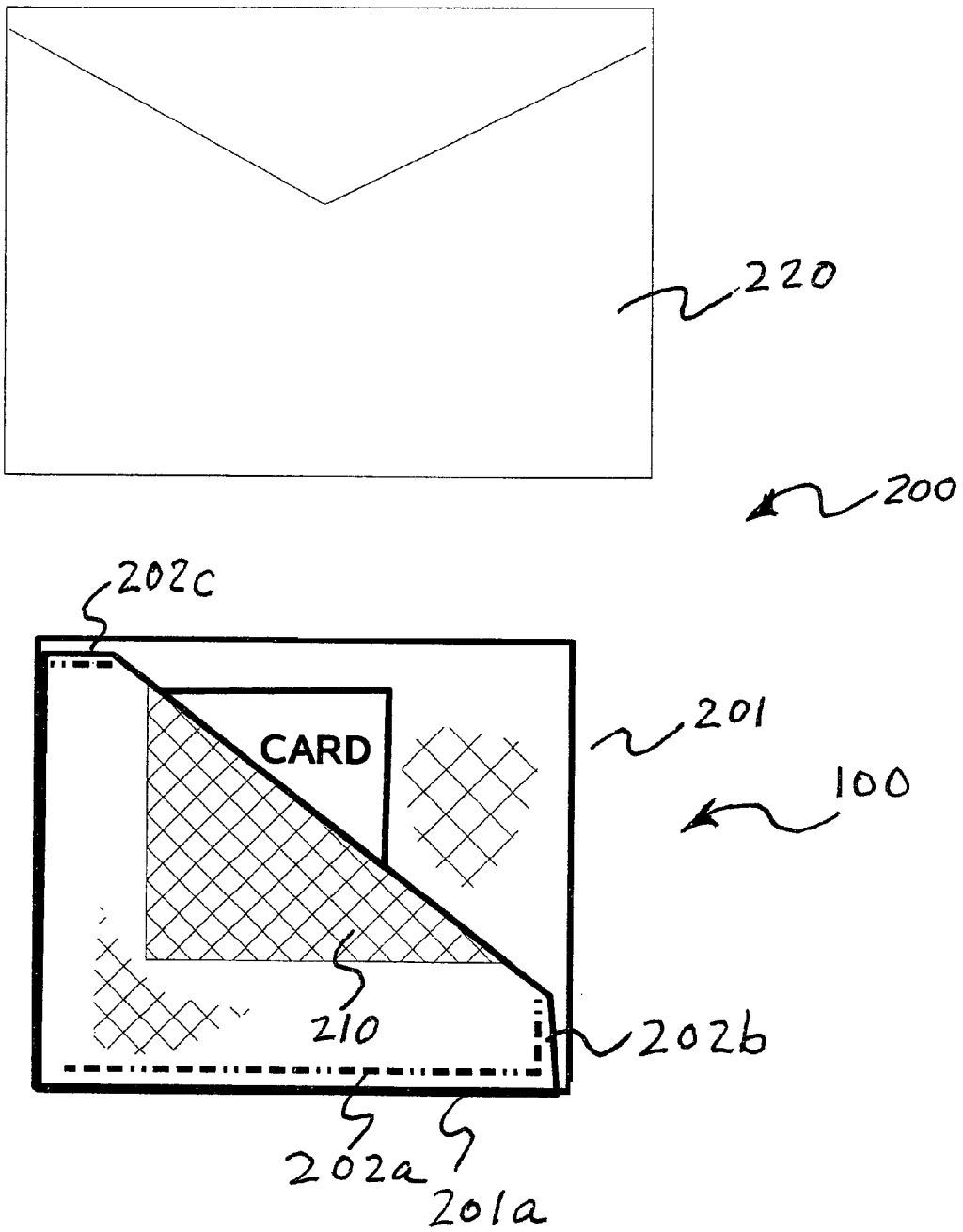
FIG. 2 is a front elevation of another embodiment of the invention shown the card inserted in the pocket formed by the front and rear faces of the fabric cover.
Figure 3:
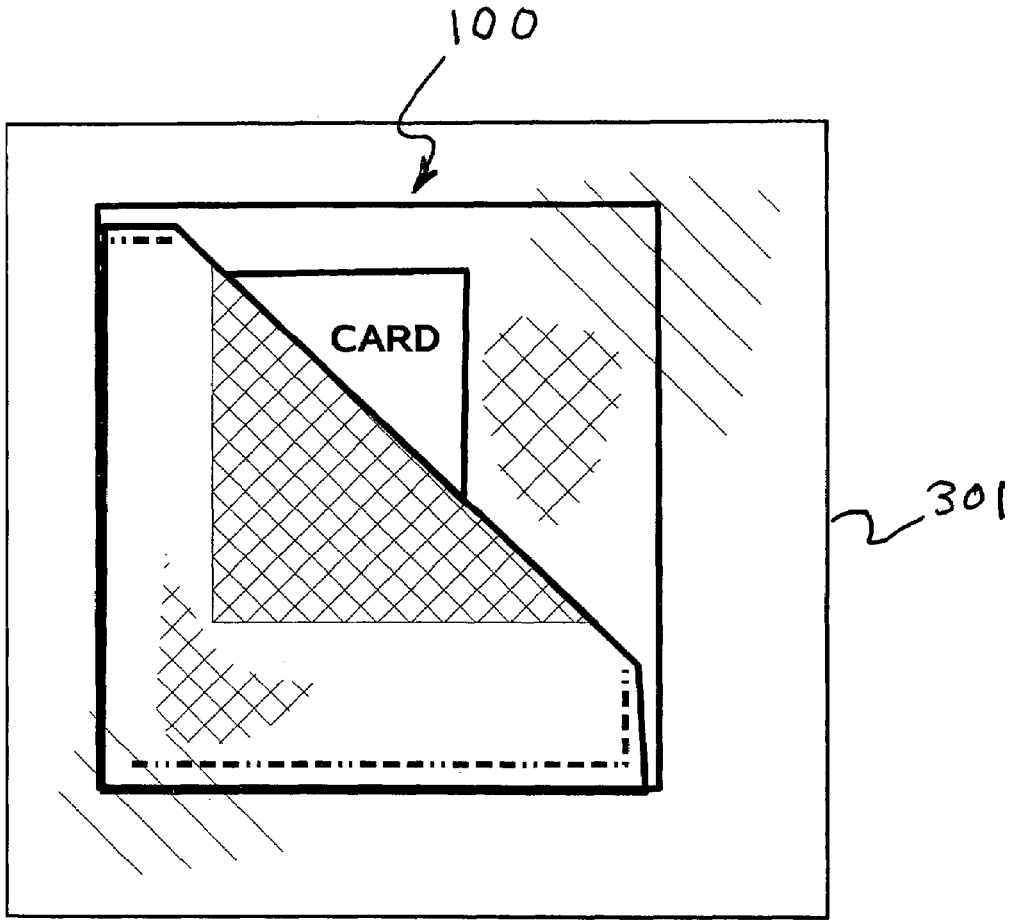
FIG. 3 is a front elevation of another embodiment of the invention showing the card and pocket in a transparent protector.

Referring to FIG. 2, the protector or pocket 100 is preferably formed of a piece of fabric 201 folded in half and sewn 202*a* completely across the bottom 201*a* to make a rectangle or square. The fabric is sewn 202*b* from the left or right bottom, running perpendicular, approximately ¼ of the way up and is also preferably sewn 202*c* across the top from the right to left about ¼ of the way across. The un-sewn fabric 210 is then folded down to create the pocket or pouch. The card is approximately 2" and 3" or larger and is made up of a heavy greeting card like paper with the heart warmer logo imprinted at the top one-half. The bottom two-thirds is preferably blank for writing a personal message. The package 200, shown in FIG. 2 may consists of an envelope 220 large enough for the pocket 100 to fit into for mailing. The instructions, the pocket, its contents, and the envelope are placed in clear packaging 301, shown in FIG. 3. While the invention has been described in connection with a preferred embodiment, it is not intended to limit the scope of the invention to the particular form set forth, but on the contrary, it is intended to cover such alternatives, modifications, and equivalents as may be within the spirit and scope of the invention as defined by the appended claims.

I claim:

1. A note card protector comprising:

a. a substantially rectangular fabric cover folded to define a front face overlapping a rear face of substantially the same dimensions, b. wherein the front and rear faces are sewn together along at least common top, bottom and side edges leaving an upward extending partially un-sewn side and a laterally extending partially un-sewn top edge, defining a pocket between the front and rear face, c. wherein at least a portion of the front face that is not sewn to the rear face is folded over itself to at least partially expose the pocket between the front and rear face when viewed from the front face and d. further comprising a note card inserted into the partially exposed pocket so that a message or greeting is visible on the surface thereof.

2. A note card protector according to claim 1 where said note card is folded over to provide an interior writing surface.

3. A note card protector comprising:

a. a substantially rectangular fabric cover folded to define a front and a rear face of substantially the same dimensions, each face having a top edge, a bottom edge, and left and right edges, the overlapped bottom edge of each of the front and rear faces forming a common bottom edge, b. wherein the front and rear faces are sewn together along at least the common bottom edge, top edge and one of the side edges leaving an upward extending partially un-sewn side and a laterally extending partially un-sewn top edge, c. wherein at least a portion of the front face that is not sewn to the rear face is folded over itself to at least partially expose the pocket between the front and rear face when viewed from the front face, and further comprising a note card inserted into the partially exposed pocket so that a message or greeting is visible on the surface thereof, d. wherein about ¼ of the upward extending edge of the side adjacent to the bottom edge is sewn together.

4. A note card protector according to claim 3 wherein the front and rear face are formed by folding a single piece of fabric.

5. A note card protector according to claim 4 wherein about ¼ of the laterally extending top edge is sewn together that is opposite the upward extending edge that is sewn together.

6. A note card protector according to claim 3 wherein about ¼ of the laterally extending top edge is sewn together that is opposite the upward extending edge that is sewn together.

7. A greeting card mailing system comprising:

a. an envelope b. a substantially rectangular fabric cover folded to define a front face overlapping a rear face of substantially the same dimensions, each face having a top edge, a bottom edge, and left and right edges, the overlapped bottom edge of each of the front and rear faces forming a common bottom edge, i. wherein the front and rear faces are sewn together along at least the common bottom edge, top edge and one of the side edges leaving an upward extending partially un-sewn side and a laterally extending partially un-sewn top edge defining a pocket between the front and rear face;

ii. wherein at least a portion of the front face that is not sown to the rear face is folded over itself to at least partially expose the pocket between the front and rear face when viewed from the front face, c. a note card dimensioned to be received in the partially exposed pocket without extending substantially past the boundary of said fabric cover, wherein said fabric cover is dimensioned to fit within the boundary of said envelope.

8. A greeting card mailing system according to claim 7 wherein said note card is folded over to provide an interior writing surface.

9. A greeting card mailing system according to claim 7 wherein the front and rear face of said fabric cover are formed by folding a single piece of fabric.

10. A greeting card mailing system according to claim 9 wherein the front and rear face of said fabric cover are sewn together from about ¼ of the upward extending edge of the side adjacent to the bottom edge.

11. A greeting card mailing system according to claim 10 wherein the front and rear face of said fabric cover are sewn together from about ¼ of the laterally extending top edge opposite the upward extending edge that is sewn together.

12. A greeting card mailing system according to claim 7 wherein the front and rear face of said fabric cover are sewn together along about ¼ of the upward extending edge of the side adjacent to the bottom edge.

13. A greeting card mailing system according to claim 7 and further comprising a layer of transparent packaging surrounding at least the fabric cover for displaying said note card.

* * * * *